United States Patent [19]

Pecheux

[11] Patent Number: 4,577,623

[45] Date of Patent: Mar. 25, 1986

[54] SPLINT MOBILIZING AN UPPER LIMB

[75] Inventor: Jean C. Pecheux, Charleville Mezieres, France

[73] Assignee: Compagnie Generale de Materiel Orthopedique, France

[21] Appl. No.: 549,242

[22] Filed: Nov. 3, 1983

[30] Foreign Application Priority Data

Nov. 8, 1982 [FR] France ..... 82 19102

[51] Int. Cl.[4] ..... A61H 1/02; A63B 21/24

[52] U.S. Cl. ..... 128/25 R; 272/129

[58] Field of Search ..... 128/25 R, 77, 87 R; 272/116, 117, 130, 93, 129

[56] References Cited

U.S. PATENT DOCUMENTS

| | | | |
|---|---|---|---|
| 2,614,558 | 10/1952 | Louell | 128/87 |
| 3,089,700 | 5/1963 | Hotas | 128/25 R |
| 3,472,222 | 10/1969 | Aplin | 128/25 R |
| 3,578,800 | 5/1971 | DiNepi | 272/73 |
| 3,989,240 | 11/1976 | Victor et al. | 272/134 |

FOREIGN PATENT DOCUMENTS

| | | | |
|---|---|---|---|
| 2440187 | 5/1980 | France | 128/77 |

*Primary Examiner*—Richard J. Apley
*Assistant Examiner*—Kathleen J. D'Arrigo
*Attorney, Agent, or Firm*—Pravel, Gambrell, Hewitt & Kimball

[57] ABSTRACT

The present invention relates to orthopedic equipment and more particularly to a splint for mobilizing an upper limb, which comprises a vertical framework supporting, in its upper part, a brachial cradle articulated about a horizontal geometrical axis, intended substantially to coincide with the scapulo-humeral joint of the upper limb, and which is connected to the framework by a drive member capable of pivoting the cradle about said axis in movements of abduction/adduction with respect to the framework, said cradle being provided with an adjustable axial extension bearing a bent bar whose part substantially parallel to the extension supports an adjustable antebrachial splint. The invention is applicable to the functional reeducation of the scapulo-humeral joint.

11 Claims, 6 Drawing Figures

SPLINT MOBILIZING AN UPPER LIMB

The present invention relates to medico-surgical equipment, namely to means for the orthopedic treatment or functional reeducation of the upper limbs.

The invention relates more particularly to the functional reeducation of the scapulo-humeral joint.

For these purposes, static support structures have already been proposed, which makes it possible to immobilize an upper limb by means of cradles which may be adjusted in a predetermined relative position of inclination.

When the desired aim is to immobilize an upper limb, such devices are satisfactory although the structures proposed at present are heavy and cumbersome.

On the other hand, when it is question of orthopedic treatment or functional reeducation, it is imperative that the upper limb be moved. The splints of the above-mentioned type do not enable such an objective to be attained.

To overcome this drawback, splints have been proposed which comprise a support frame on which is fitted an articulated structure adapted to bear the upper limb to be reeducated. The articulated structure is associated with a system of pulleys-cables-counterweights which give it a determined stable position whilst possibly allowing the articulated system a relative displacement by pivoting.

The articulated system can be pivoted only by manual action exerted either by the patient or by a third party.

Such devices provide a passive mobilization, but do not give satisfaction as they are cumbersome nd delicate to adjust to the point of equilibrium as a function of the patient's morphology and of the amplitude of mobilization to be attained. In addition, they require special positioning or implantation so as to allow a third party to intervene or the patient to act directly in order to control pivoting of the articulated system against the action of the counterweights.

Another drawback of the above devices resides in the fact that, although relative mobilization is possible, it is limited in amplitude and is, in addition, restricted to an abduction/adduction movement without possibility of mobilization of the scapulo-humeral joint in inward or outward rotation.

It is an object of the invention to overcome the above drawbacks by proposing a novel splint for mobilizing an upper limb, particularly designed to allow an efficient, automatic or controlled mobilization in abduction/adduction movement, of adjustable amplitude. Another object of the invention is to propose a splint for immobilizing upper limbs which, when this proves necessary, allows a mobilization in outward/inward rotation of the scapulo-humeral joint concommitantly with the movements of abduction/adduction.

The object of the invention is designed so that these results are obtained without intervention by a third party and without obliging the patient himself, insofar as he is physically able to, to exert an action of traction in order to control, against the influence of counterweights, the deformation of the articulated system on which the upper limb to be reeducated is immobilized.

The means of the invention thus enable a patient to make the desired movements at determined progressive amplitudes, as it suits him, and thus to participate in the functional mobilization of the scapulo-humeral joint by selecting a program of amplitude gain adapted to the movements of abduction/adduction or of rotations.

It is a further object of the invention to propose a splint for mobilization comprising a function of functional reeducation in active rotations which may, as desired, be equally well aided or impeded, in the outward or inward direction.

It is another object of the invention to propose a novel splint for mobilization which may be easily adjusted as a function of the patient's size or of the segmentary lengths of the upper limb to be reeducated.

Yet another object of the invention is to propose a novel splint for mobilization which may be easily adapted to the patient's state, allowing functional reeducation whatever the sitting or standing position occupied by the patient.

To attain the objectives set forth hereinabove, the object of the invention is characterized in that it comprises a vertical frame supporting in its upper part a brachial cradle which is articulated about a horizontal geometrical axis intended substantially to coincide with the scapulo-humeral joint of the upper limb, and which is connected to the frame by a drive member capable of pivoting the cradle about the axis in abduction/adduction movements with respect to the frame, said cradle being provided with an adjustable axial extension bearing a bent bar whose part substantially parallel to the extension supports an adjustable antebrachial splint.

The invention will be more readily understood on reading the following description with reference to the accompanying drawings, in which.

Figure 1:
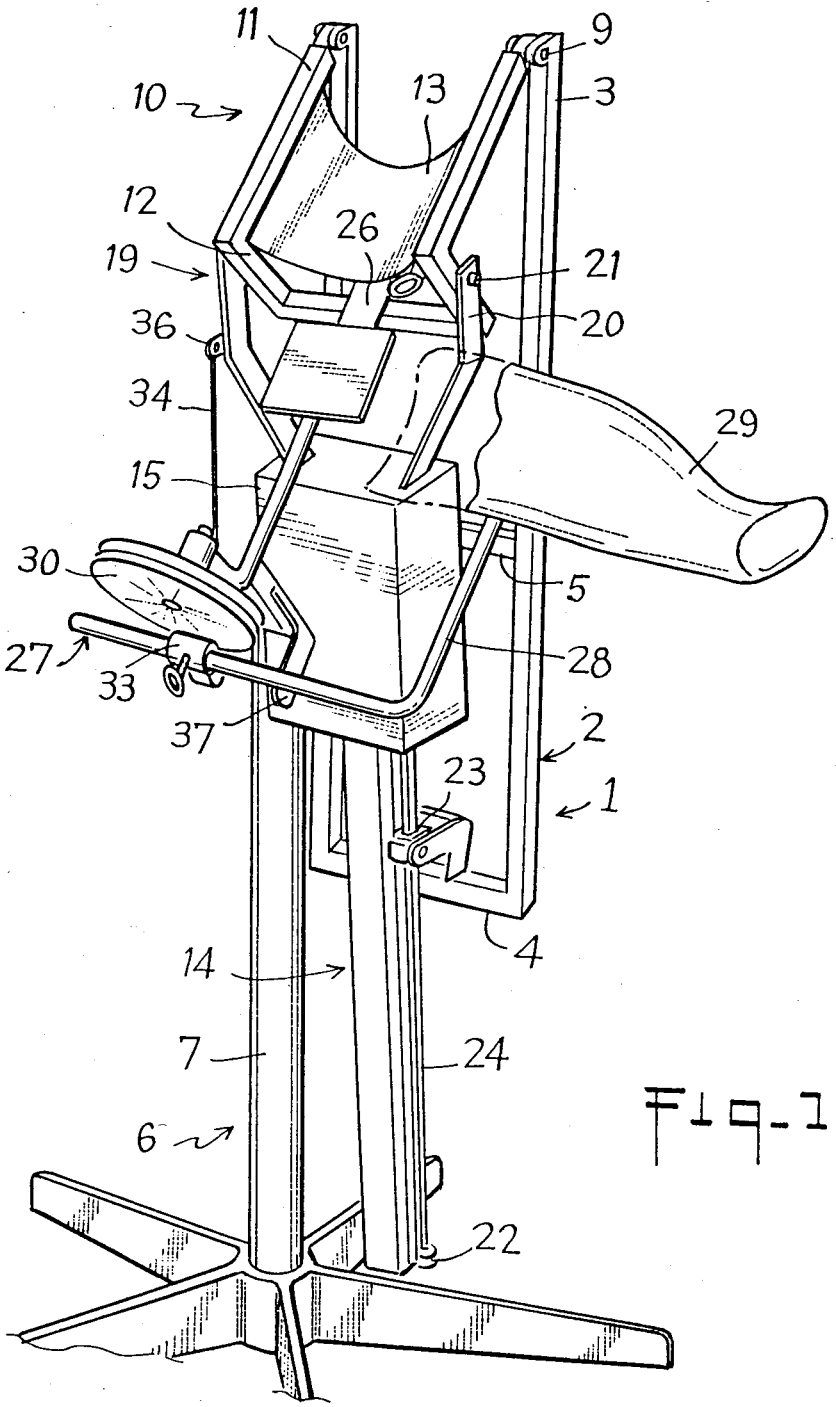
FIG. 1 is a view in perspective of the splint according to the invention.
Figure 2:
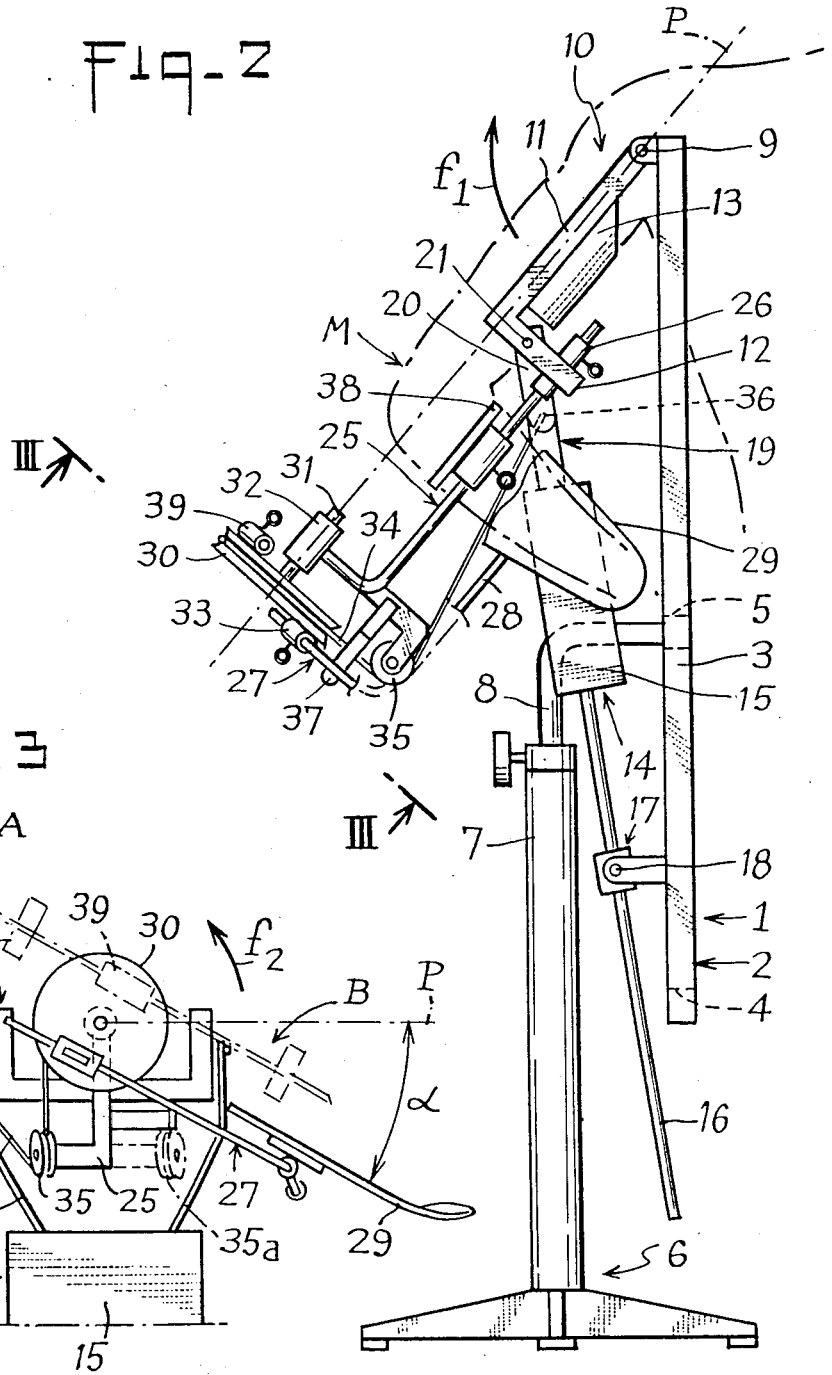
FIG. 2 is an elevation, with parts torn away, showing the splint in a characteristic position of operation.
Figure 3:
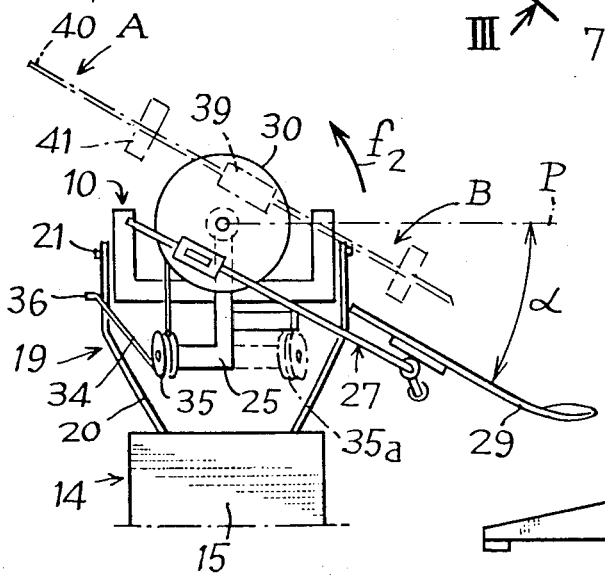
FIG. 3 is a transverse view taken substantially along line III—III of FIG. 2.

Referring now to the drawings, FIGS. 1 to 3 show the splint for mobilization of an upper limb which comprises a vertical framework 1 intended to be immobilized by any suitable means adapted to the state of the patient whose upper limb is to be reeducated.

The vertical framework 1 may thus be mounted on the bearing frame of a seat.

In the embodiment illustrated, the vertical framework 1 comprises a chassis 2 in the form of a frame, for example constituted by two uprights 3 connected together by at least one lower crosspiece 4 and a substantially median crosspiece 5. The chassis 2 is fitted on a support 6 which is preferably constituted by a stand provided with a shaft 7 for vertically adjusting a telescopic member 8 fast with chassis 1.

Chassis 1 supports, in its upper part, by a horizontal geometrical pivot pin 9, a brachial cradle 10 adapted to pivot in a vertical plane, preferably on the side of framework 1 corresponding to support 6. The brachial cradle 10 is constituted by two side bars 11 connected together, opposite the geometrical axis 9, by a transverse bow 12. The side bars 11 are also connected together by a support means 13 which may be constituted by a splint, a strap, removable hammock, etc.

The horizontal geometrical axis of articulation 9 is intended to coincide substantially with the scapulo-humeral joint of an upper limb such as M shown in chain-dotted lines in FIG. 1. To this end, the chassis 1 is constituted so that the uprights 3, having no connection therebetween in their upper part, support the side bars 11 by means of independent coaxial pivot pins. To the same end, the connecting means 13 is provided to extend between the side bars 11 recessed with respect to or at a distance from the pins for articulation with the uprights 3. These structural arrangements make it possible to fit the chassis and the cradle beneath limb M and thus to place the geometrical axis 9 in coincidence with the scapulo-humeral joint.

The brachial cradle 10 is connected to chassis 1 by a drive member 14 capable of pivoting cradle 10 in the vertical plane in a movement of abduction/adduction from the position shown in FIG. 2. The drive member 14 is preferably of the linear type and may be constituted by a screw jack, a pneumatic jack, a hydraulic jack. FIG. 1 shows an embodiment in which the drive member 14 comprises an electric motor 15 rotating a threaded rod 16 permanently cooperating with a nut 17 which is mounted, by a horizontal pivot pin 18, on an element constituting the chassis 1. The casing or housing of the electric motor 15 is extended by a fork element 19 whose arms 20 are mounted by pivot pins 21 for example on the bow 12 of the brachial cradle 10.

The drive member 14 is preferably associated with end-of-stroke reversing contactors such as for example contactors 22 and 23 borne by a rod 24 parallel to the threaded rod 16 and adapted to be actuated by physical contact with the nut 17.

The brachial cradle 10 is provided, opposite framework 1, with an axial extension 25 which is preferably constituted by a bar mounted with possibility of axial adjustment in a sleeve 26 borne by the bow 12. Extension 25 supports a bent bar 27 having an arm 28 extending parallel to extension 25 and bearing an antebrachial splint 29 whose axial position is adjustable.

The splint for mobilization described hereinabove operates as follows:

From the initial stable position shown in FIG. 2, the patient can control supply of the drive member 14 so that the latter pivots the brachial cradle, the extension 25 and the antebrachial splint 29 in the direction of arrow $f_1$ in FIG. 2. Continuous or discontinuous operation of the drive member 14 may easily be adjusted as desired by the patient acting without physical exertion on a supply control box. In this way, the patient may himself regulate the amplitude of abduction in the direction of arrow $f_1$ and possibly also the speed of angular displacement.

Figure 4:
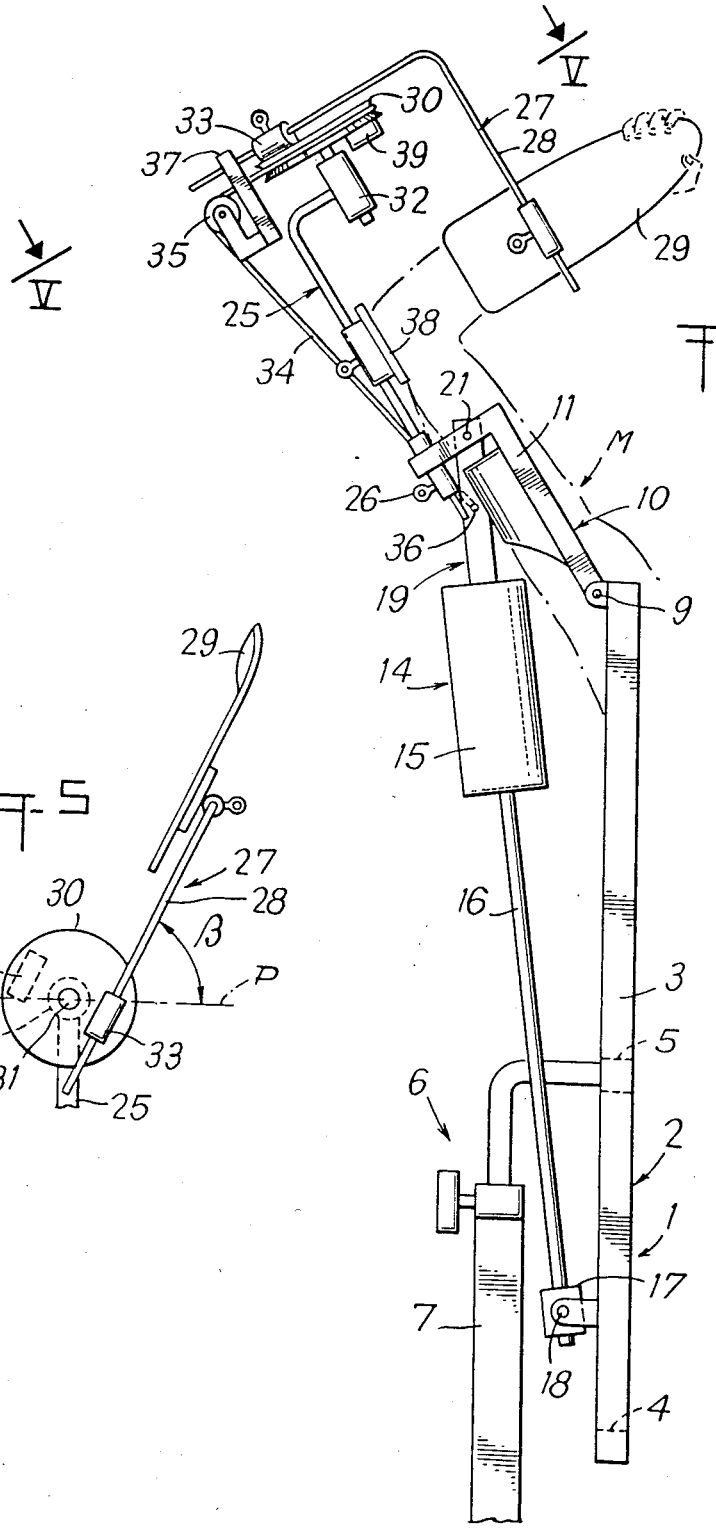
FIG. 4 is a view in elevation similar to FIG. 2, but illustrating the splint in another characteristic position of use.
Figure 5:
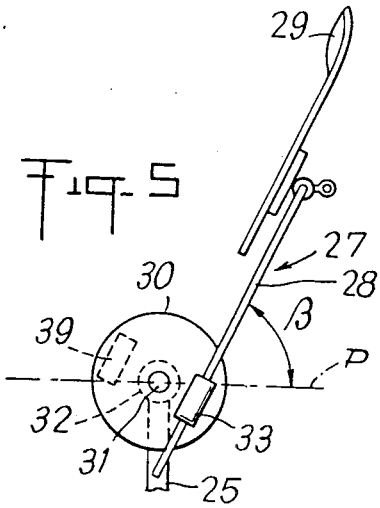
FIG. 5 is a transverse view taken substantially along line V—V of FIG. 4.

Operation of the drive member 14, provoking movement of the brachial segment 10 in abduction, may be continued up to the maximum stroke of the drive member regulated, in particular via the reversing contactor 22, to bring the brachial cradle 10 and the extension 25 in the position illustrated in FIG. 4 correponding to a maximum amplitude of movement in abduction.

According to the mode of operation used, the reversing contactor 22 may provoke reversal of supply of the drive member 14 or, on the contrary, merely interrupt this supply, thus leaving it to the patient to decide whether to reverse this supply to provoke pivoting of the brachial cradle 10 and the extension 25 in a movement of adduction in the direction opposite that of the arrow $f_1$ to return the limb M to be reeducated into the original position according to FIG. 2.

The same operation as hereinabove may produce a passive antepulsion mobilization of the shoulder. In fact, to this end, it suffices to orient the vertical framework 1 by the shaft 7 and the member 8 so that the brachial cradle 10 is placed substantially parallel to the sagittal plane of the patient's body. In such a case, the patient's arm is in extension, his hand being placed equally well in pronation or in supination.

According to another constructive dispostion of the splint according to the invention, the bent bar 27 bearing the antebrachial splint 29 is supported by the extension 25 by means of a grooved pulley 30. The spindle 31 of the pulley 30 is mounted in a bearing 32 presented by the end of the extension 25 opposite the brachial cradle 10. The bearing 32 is disposed so that the spindle 31 and the horizontal geometrical axis 9 are placed in a fictitious common plane P shown in chain-dotted lines in FIG. 2. The connection between the grooved pulley 30 and the bent bar 27 is ensured by an attachment 33 for adjusting the spacing of the arm 28 of bar 27 with respect to extension 25.

The grooved pulley 30 cooperates with a cable 34 of which one of the ends is immobilized on pulley 30. The cable 34 is taken over by a guide pulley 35 which is preferably borne by the extension 25, lying in a plane lower than plane P. Beyond guide pulley 35, cable 34 is hooked to the fork element 19 or to another part constituting the drive member 14 at a point 36 different from and lower than the pin 21 for articulation of said drive member 14 on the brachial cradle 10. The guide pulley 35, the point of connection 36 and the pivot pin 21 consequently establish a deformable triangular system of connection between the drive member 14 and the brachial cradle 10 on the one hand, and the grooved pulley 30 on the other hand.

The initial adjustment of the length of cable 34 is effected so that, in the stable rest position corresponding to a maximum state of adduction, as illustrated in FIG. 2, the grooved pulley 30 maintains the plane of support constituted by the antebrachial splint 29 in an inclination $\alpha$ with respect to the plane P and corresponding to a maximum state of inward rotation of limb M. This position is preferably also determined by a stop 37 extending from the extension 25, so as to cooperate, for example, with the bent bar 27.

Although this has not been shown, the stop 37 may be shaped and disposed so as to cooperate for example with a catch or tappet borne by the grooved pulley 30.

The splint constituted as set forth hereinabove allows a movement of rotation concomintant with the movement of abduction generated by the drive member 14. In fact, from the position illustrated in FIG. 2, the effect of the brachial cradle 10 pivoting in the direction of arrow $f_1$ is to deform the triangular connection initially established by the guide pulley 35, the point of connection 36 and the pin 21. As this pivoting continues, the distance between the guide pulley 35 and point 36 increases, which causes the cable 34 to rotate the grooved pulley 30 in the direction of arrow $f_2$ from the position illustrated in FIG. 3.

The movement of abduction imposed on limb M concomitantly produces a movement of outward rotation on the scapulo-humeral joint and consequently provides a complete functional reeducation of limb M.

The amplitude of outward rotation is attained when the brachial cradle 10 reaches the position of maximum abduction as illustrated in FIG. 4. In this state, the rotation of pulley 30 has then brought the plane of support of the antebrachial splint in an inclination $\beta$ with respect to plane P and corresponding to a morphologically maximum amplitude of outward rotation. A displacement in a movement of adduction from this position produces, inversely, a concomitant inward rotation.

The patient may thus decide, as desired, either on automatic operation or on a controlled operation of the drive member 14 to provoke a movement of abduction-/adduction only, or, on the contrary, to produce, concomitantly to this movement, an outward/inward rotation of the limb M on the scalpo-humeral joint.

Figure 1A:
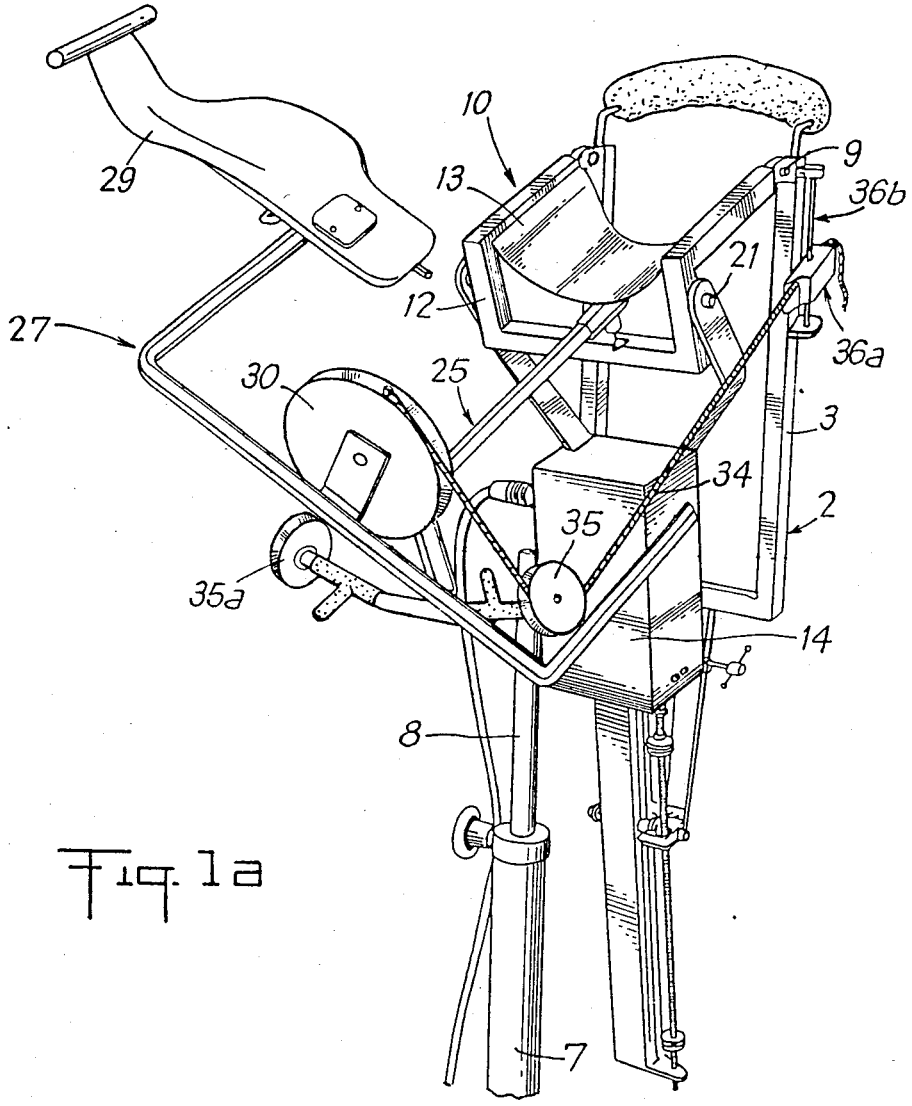
FIG. 1A is a perspective view similar to FIG. 1, but in a different direction, through substantially 90°, and showing a detail of embodiment.

To facilitate adjustment of amplitude of concomitant inward/outward rotation or, on the contrary, to allow abduction/adduction, it appears preferable to fix the cable 34 not to point 36 but on a cursor 36*a* (FIG. 1A) adjustably mounted on a slide 36*b* borne by the top part of the framework 2. The cursor 36*a*, by its adjustment on the slide 36*b*, makes it possible to modify the amplitude of pivoting in the direction of arrow $f_2$ (FIG. 3). The slide 36*a* also enables the point of fixation of the cable 34 to be brought substantially into coincidence with the geometrical axis 9 so that operation of the drive member 14 only generates a movement of abduction/adduction without concomitant rotation.

The antebrachial segment of limb M may be held on splint 29 either by the patient manually gripping directly, or by using a strap.

The extension 25 is provided with an axially adjustable support plate 38 adapted to support the elbow of limb M, so as to facilitate rotation of limb M.

According to another arrangement of the invention, the pulley 30 is provided to comprise an attachment 39 allowing fixation of a rigid rod 40 as illustrated in chain-dotted lines in FIG. 3. The rod 40 is intended to support a counterweight 41 with adjustable position.

Consequently, by eliminating the connection between pulley 30 and drive member 14 by cable 34, it becomes possible to place the brachial cradle 10 in a determined abduction position. The patient himself may then actively control a functional reeducation in aided outward rotation and in impeded inward rotation in consideration of the position of rod 40 and the counterweight 41 defined by reference A in FIG. 3. This Figure shows that the attachment 39 is preferably in the form of a sleeve so as to enable rod 40 and counterweight 41 to take position B so as to allow an active mobilization in impeded outward rotation and in aided inward rotation.

It should be noted that an aided inward rotation may also take place after disconnection of cable 34 by the simple effect of gravity resulting from the bearing of the antebrachial segment of limb M on the splint 29, as far as the position of immobilization determined by stop 37.

FIG. 3 shows in chain-dotted lines that the extension 25 may be made so as to allow adaptation of a pulley 35*a* in order to enable the splint to be used equally well for a right- or left-hand limb M. In such a case, the position of the bent bar 27 is then reversed.

The invention is not limited to the examples described and shown, as various modifications may be made thereto without departing from its scope.

What is claimed is:

1. A splint allowing mobilization of an upper limb, wherein it comprises a vertical framework supporting, in its upper part, a brachial cradle which is articulated about a horizontal geometrical axis intended substantially to coincide with the scapulo-humeral joint of the upper limb, and which is connected to the frame by a drive member capable of pivoting the cradle about said axis in abduction/adduction movements with respect to the framework, said cradle being provided with an adjustable axial extension bearing a bent bar whose part substantially parallel to the extension supports an adjustable antebrachial splint.

2. The splint of claim 1, wherein the extension of the cradle bears an adjustable plate for supporting the elbow of the upper limb.

3. The splint of claim 1, wherein the cradle extension comprises:

an extension bar attached to the brachial cradle and extensible therefrom, the axis of the extension being parallel with the brachial cradle axis;

a rotatable pulley attached to the extension bar, the pulley rotational axis being parallel with the brachial cradle axis;

a guide pulley;

a cable attached at one end to the rotatable pulley and at the other end to the drive member at a point different from the connection point of the drive member to the brachial cradle and routed over the guide pulley so that a deformable triangle results;

a bent bar having a portion of the bent bar connected to the rotatable pulley and another portion which supports an adjustable antebrachial splint and is parallel to the brachial cradle axis such that as the brachial cradle articulates in the abduction/adduction direction, the cable causes the rotatable pulley to rotate, causing the bent bar to rotate about the brachial cradle axis, resulting in a concomitant outward/inward rotation of the upper limb.

4. The splint of claim 3, wherein the bearing is disposed so that its axis is placed in the same fictitious plane as the geometrical axis of articulation of the brachial cradle.

5. The splint of claim 3, wherein the guide pulley is mounted on the extension which also bears a stop limiting the inward rotation of the bent bar.

6. The splint of claim 3, wherein the drive member is connected to the brachial cradle by a fork element on one of the arms of which the cable is fixed, below the point of articulation with said cradle.

7. The splint of claim 3, wherein the grooved pulley bears an attachment for a rod supporting an axially adjustable counterweight.

8. The splint of claim 1, wherein the drive member is associated with end-of-stroke reversing contactors.

9. The splint of claim 1, wherein the vertical framework is in the form of a chassis mounted on a support in vertically adjustable manner.

10. The splint of claim 1, wherein the vertical frame has a lower part and an upper part, the upper part comprised of two vertical uprights, each upright containing a pivot pin, the two pivot pins being aligned coaxially, and wherein the brachial cradle has two ends, with one end comprised of two parallel side bars, such that each side bar is connected to a pivot pin, thereby allowing the brachial cradle to articulate.

11. The splint of claim 1, wherein the cradle extension comprises:

an extension bar attached to the brachial cradle and extensible therefrom, the axis of the extension being parallel with the brachial cradle axis;

a rotatable pulley attached to the extension bar, the pulley rotational axis being parallel with the brachial cradle axis;

a guide pulley;

a slide attached to the vertical framework;

a cursor attached to the slide and capable of being affixed to the slide at several positions;

a cable attached at one to the rotatable pulley and at the other end to the cursor and routed over the guide pulley so that a deformable triangle results;

a bent bar having a portion of the bent bar connected to the rotatable pulley and another portion which supports an adjustable antebrachial splint and is parallel to the brachial cradle axis such that as the brachial cradle articulates in the abduction/adduction direction, the cable causes the rotatable pulley to rotate, causing the bent bar to rotate about the brachial cradle axis, resulting in a concomitant outward/inward rotation of the upper limb.

* * * * *